United States Patent [19]

Muller

[11] Patent Number: 4,987,629

[45] Date of Patent: Jan. 29, 1991

[54] DECK FOR WIDE-SPAN BRIDGE

[76] Inventor: Jean M. Muller, 13 Rue Victor Hugo, 92150 Suresnes, France

[21] Appl. No.: 326,786

[22] Filed: Mar. 21, 1989

[30] Foreign Application Priority Data

Mar. 25, 1988 [FR] France ..... 88 03957

[51] Int. Cl.[5] ..... E01D 11/00

[52] U.S. Cl. ..... 14/6; 14/14; 14/22; 14/23

[58] Field of Search ..... 14/3, 4, 6, 14, 18, 14/19, 20, 21, 22, 23; 52/223 R, 223 L

[56] References Cited

U.S. PATENT DOCUMENTS 3,975,476 8/1976 Finsterwalder ..... 14/23 X
4,473,915 10/1984 Finsterwalder ..... 14/21
4,625,354 12/1986 Richard ..... 14/18 X
4,706,436 11/1987 Mabey et al. ..... 14/4 X

*Primary Examiner*—William P. Neuder
*Attorney, Agent, or Firm*—A. W. Breiner

[57] ABSTRACT

A bridge, the deck of which comprises two superimposed frames (4,5) each serving as a roadway. These frames are connected by diagonal connecting girders (6) slanting both relative to the vertical and relative to the length of the bridge and joining the edges of the upper and lower frames, and auxiliary connecting girders (7) situated in vertical planes passing through the edges of the lower frame. The prestressing cables (17) of a diagonal girder (6) are anchored to the edge of the upper frame, pass transversely through the lower frame, and then through the diagonal girder which is symmetrical therewith relative to the longitudinal vertical plane of symmetry of the bridge, and are anchored on the opposite edge of the upper frame.

10 Claims, 7 Drawing Sheets

DECK FOR WIDE-SPAN BRIDGE

The present invention relates to a bridge, in particular a wide-span bridge of the cable-stayed type, capable of handling a large volume of traffic owing to the presence of roadways situated in superimposed planes, one of them being used for railroads, for example, and the other for automobile traffic.

According to the present state of the art, either suspension bridges or cable-stayed bridges are used in order to cover large spans. Suspension bridges are economically justified for exceptional spans, but their flexibility poses problems for the traffic, in particular the railroad traffic, and as regards the aeroelastic flexibility. For their part, cable-stayed bridges are not so sensitive to wind as suspension bridges, particularly if the deck is made of concrete, a material which provides the structure with an adequate weight and great rigidity. The weight, however, limits the spans such that, outside the area of application of concrete cable-stayed bridges, decks with a mixed steel/concrete structure or all-metal decks have been used.

According to the present state of the art, cable-stayed decks with a mixed steel/concrete structure have always consisted of an upper concrete frame forming the roadway surface, supported by transverse and longitudinal reinforcing girders intended to transfer the loads to the stay cables while ensuring that the deck is sufficiently rigid. Constructions of this type are recent and highlight the present limitations of the known means, in the following areas:

coexistence of the metal structure and concrete as regards the effects of shrinkage and slow deformation of the concrete;

the appearance of temperature gradients created by the exposure to sun of metal surfaces with a low thermal inertia;

the risk of overall buckling of the structure owing to instability of the lower frame of longitudinal strengthening girders, when the stresses due to the loads, in addition to the abovementioned effects, approach the elastic compression limit of the metal;

the very low strength of this type of structure with regard to accidental forces such as the impact of a lorry against a stay cable.

Several of these drawbacks may be overcome by increasing the height and size of the longitudinal strengthening girders, but to the detriment of the wind exposure profile and economy.

Use may also be made of lattice structures, since they enable great flexural and torsional strength to be obtained at a low cost, while ensuring maximum transparency with regard to the wind. According to the present state of the art, such lattice structures generally combine steel and concrete, but, despite large-scale research in this area, no really satisfactory solution has been found to transfer the forces between the frames and the diagonal members to the various lattice intersections. The long-term behavior of such solutions is not known and the production costs remain high.

The object of the present invention is to remedy all the abovementioned drawbacks by proposing a new structure which is both light, rigid and easy to manufacture and hence low-cost.

To achieve this object, the invention provides a bridge consisting of a deck and means for supporting this deck, the deck comprising:

an upper frame forming a traveling surface;

a lower frame forming a traveling surface, narrower than the upper frame;

prestressed connecting girders, known as "diagonal members", slanting both relative to the vertical and relative to the length of the bridge and joining the edges of the upper and lower frames;

auxiliary connecting girders, also prestressed, situated more or less in vertical planes passing through the edges of the lower frame, these auxiliary girders forming, together with the diagonal members and the frames, a very rigid spatial lattice;

this bridge having the special feature that the prestressing cable(s) of a diagonal girder are anchored to the edge of the upper frame, pass tranversely through the lower frame and then through the diagonal girder which is symmetrical therewith relative to the longitudinal vertical plane of symmetry of the bridge, and are anchored onto the opposite edge of the upper frame.

This thus results in the elimination of a certain number of anchorage points, a lightened structure and much greater rigidity for the same weight.

Preferably, the prestressing cable(s) of an auxiliary girder are also anchored in the upper frame, pass transversely through the lower frame, pass into the auxiliary girder which is symmetrical therewith relative to the longitudinal vertical plane of symmetry of the bridge, and pass back so as to be anchored onto the upper frame.

In a preferred embodiment, the auxiliary girders are located at the intersection of the vertical planes parallel to the axis, and plane perpendicular to these vertical planes, containing the diagonal girders. An optimum load distribution is thus obtained.

Preferably, the upper frame consists of a thin slab reinforced by transverse girders situated at the point where the diagonal girders and, where applicable, the auxiliary girders join said upper frame.

According to one embodiment, the lower frame is of the metal type with longitudinal cages, having concrete blocks for effecting connection with the prestressing cables of the diagonal and auxiliary girders.

According to another embodiment, the lower frame consists of prefabricated concrete elements assembled in the longitudinal direction. The choice between these two solutions is, essentially, a question of weight and cost.

When the bridge according to the invention is of the radiating cable-stayed type, provision may be made for the upper deck to be formed by the assembly of elements prefabricated or cast in position, at least some of which have a stop intended to retain the anchoring head of a stay cable, and the adjacent element has an auxiliary stop intended to bear against the stop retaining the anchoring head of the stay cable, this auxiliary stop being intended to retain the anchoring head of a longitudinal prestressing cable of the deck, exerting a force directed longitudinally in the opposite direction to the stay cable, to such an extent that the combined action of the stay cable and the prestressing cable tends to clamp the two prefabricated elements against each other.

In the case where the bridge according to the invention is of the radiating cable-stayed type, with at least one pylon in the shape of an inverted V for supporting the stay cables, provision is advantageously made for the deck to be located between the uprights of the pylon, and for slanting braces, situated in the transverse plane of the pylon, to join the deck to the pier supporting the pylon, so as to ensure the stability of the deck with regard to horizontal forces.

According to an advantageous method of constructing the bridge according to the invention, on the one hand, a unit length of upper frame and, on the other hand, an assembly consisting of an equal length of lower frame and auxiliary and diagonal connecting girders associated with this length are arranged in position at the end of one already assembled deck part, and this upper frame length and this assembly are both assembled with the already assembled deck part, with the aid of a movable girder mounted in cantilever fashion on the already assembled deck part.

The invention will now be described in greater detail with the aid of practical examples illustrated with drawings, in which.

Figure 1:
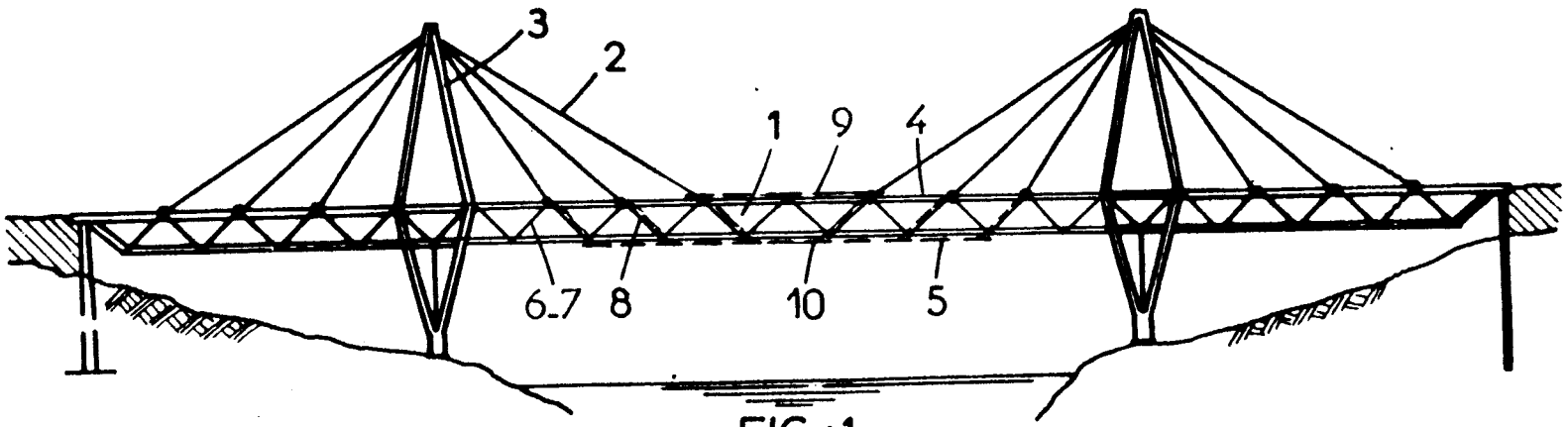
FIG. 1 is a schematic elevation view of a cable-stayed bridge according to the invention.

In the embodiment of FIG. 1, the bridge according to the invention comprises a deck 1, suspended from stay cables 2, at regularly spaced points, these stay cables being fixed towards the top of the support mast, or pylon. For the sake of clarity, the central span is shown with eight elements only, suspended from three stay cables on either side of the key element. In fact, in large-span bridges, the spacing of the stay cables may vary from 10 to 20 meters, and the number of stay cables in the central half-span may be as many as twenty to twenty-five.

The deck comprises an upper frame 4, forming a roadway, and a lower frame 5, which forms a second roadway. These two frames are connected by slanting connecting girders 6, 7, which can be seen more clearly in the following figures.

A certain number of prestressing cables 8 associated with connecting girders, and other longitudinal prestressing cables 9, 10, reinforcing the upper and lower frames of the deck, are shown in broken lines.

Figure 2:
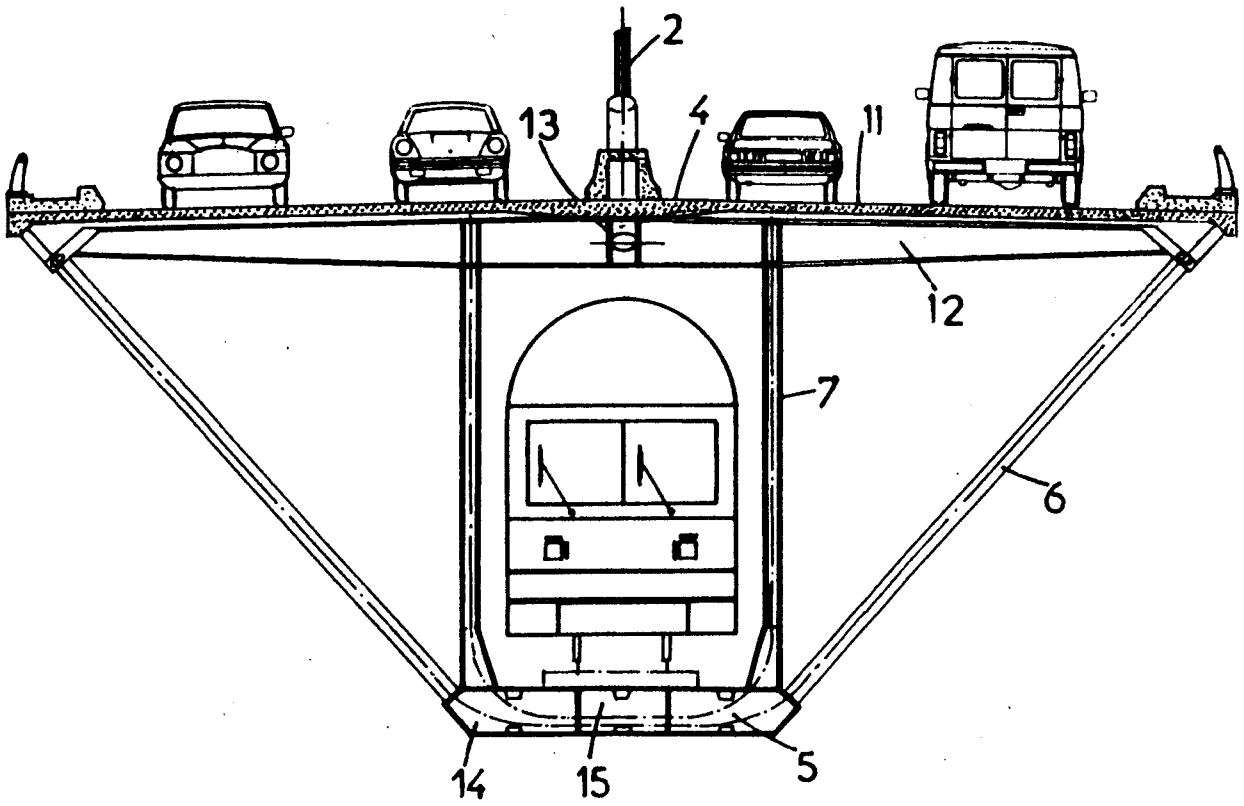
FIGS. 2 and 3 are running cross-sections of the deck, in two different embodiments.

FIG. 2 shows an embodiment of the deck which has, on its lower frame, a roadway with two travel lanes in each direction, and, on the lower frame, a railroad track.

Figure 3:
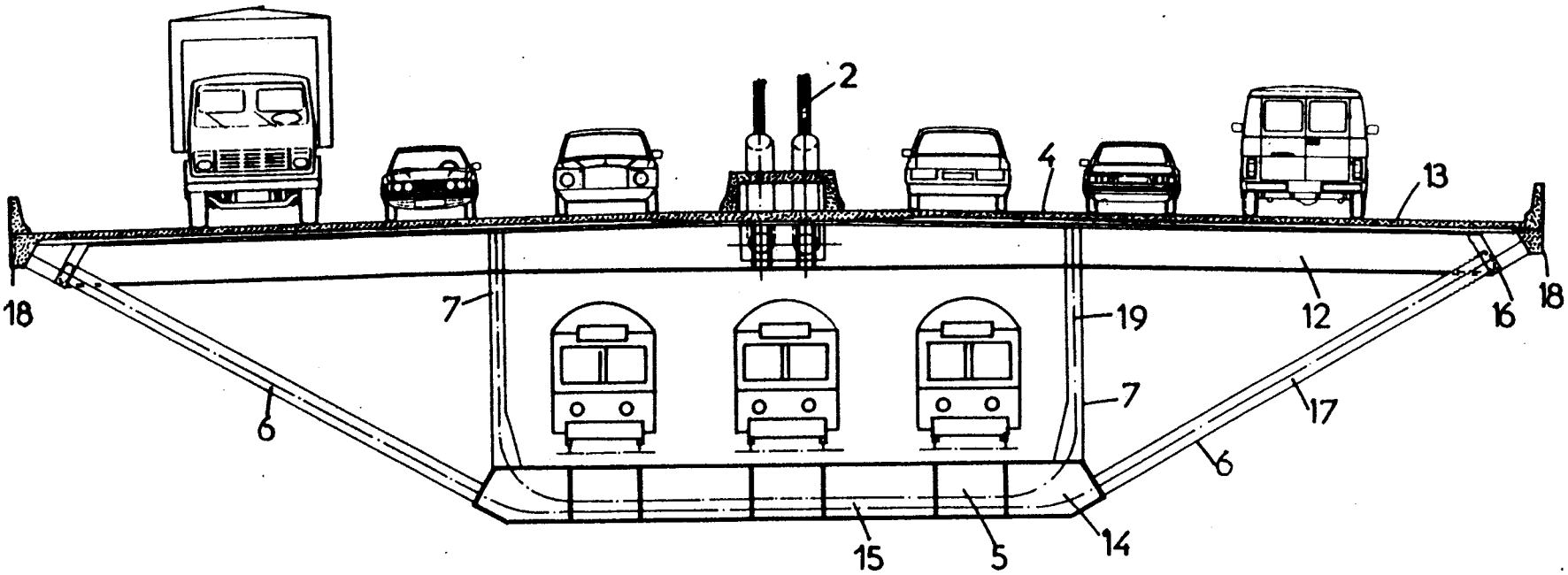

FIG. 3 shows another embodiment of the deck, for a greater volume of traffic, having, on the upper frame, roadways with three travel lanes in each direction, and, on the lower frame, three subway lines.

In both cases, the bridge is of the type in which the stay cables 2 form an axial vertical layer, or two adjacent vertical layers, supporting the deck via its central part. However, in other embodiments, in particular in the case of large-span bridges, the stay cables support the deck via its edges.

In the two figures, the arrangement of the connecting girders is the same: diagonal connecting girders join the edges of the two frames, and auxiliary girders 7 join the edge of the lower frame to the upper frame while remaining in an axial vertical plane. With reference to FIG. 1, it can be seen that the members 6 and 7 are contained in the same planes, inclined relative to the horizontal and perpendicular to the axial vertical plane of symmetry of the structure.

The upper frame 4 is formed by a relatively thin slab 11 reinforced by transverse girders 12 situated at the bottom thereof and having means 13 for attaching the stay cables.

The lower frame 5 is, in the case of these figures, a metal structure comprising longitudinal side cages 14 and middle cages 15.

The diagonal connecting girders 6 are hollow metal girders which rest, on the one hand, on a side cage 14 of the lower frame and, on the other hand, on an iron fitting 16 integral with the transverse girder 12. The auxiliary connecting girders 7, which are also hollow, rest, on the one hand, on the side cages 14 of the lower frame and, on the other hand, directly on the girder 12.

The prestressing cables 17 of the diagonal connecting girders are anchored, on the one hand, on the edge 18 of the upper slab 13. They pass in succession through a diagonal girder 6, the cages 14 and 15 of the lower frame, in a transverse plane relative to the bridge, and another diagonal girder 6, and are then attached to the opposite edge 18 of the slab 13.

The prestressing cables 19 of the auxiliary girders pass, in a similar manner, in succession through a connecting girder 7, the cages 14 and 15 of the lower frame, and the connecting girder 7. They are anchored, at both their ends, to the upper side of the girder 12.

Figure 5:
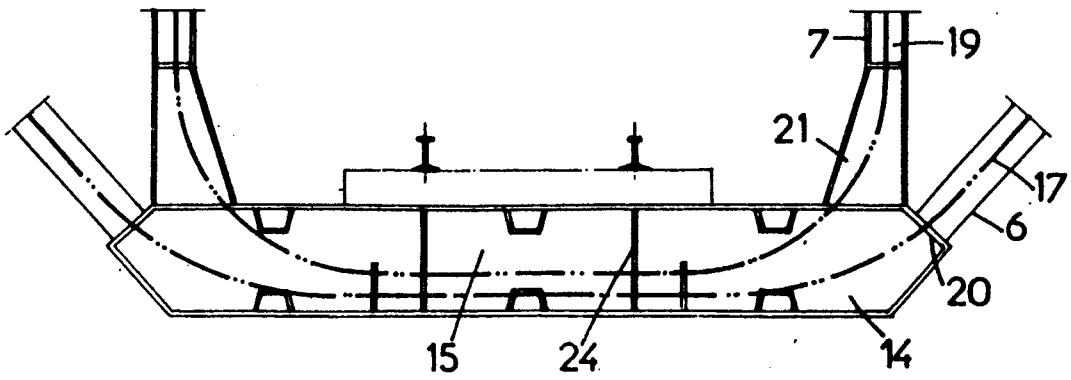

FIG. 5 is an enlarged partial view of FIG. 2, showing the structure of the lower deck in greater detail.

The cages 14 have, on their edges, slanting surfaces 20 which are perpendicular to the diagonal connecting girders 6 and on which they are supported.

On the cage 14, an auxiliary cage 21, which widens out downwards towards the center of the frame, serves as a support for the auxiliary girder 7. At the point where they join the connecting girders 6 and 7, the cages are closed by slanting transverse partitions 20, with a degree of inclination relative to the horizontal identical to that of the connecting girders. The space with a V-shaped cross-section defined by these two slanting transverse partitions 20 is filled with concrete 21 and contains the tubes 22 and 23 in which the prestressing cables, 17 and 19 respectively, are placed in order to transmit the prestressing tension to the lower frame. The change of direction of the prestressing cables 17, 19 occurs inside the tubes 22 and 23. The said cables pass perpendicularly through the longitudinal partitions 24 which separate the side cages 14 from the middle cages 15. As can be seen in FIG. 5, these partitions 24 are positioned in line with the rails of the railroad track.

Figure 8:
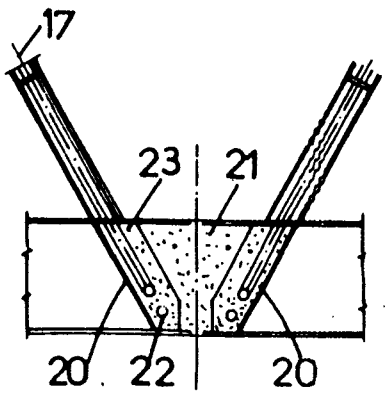
FIGS. 7 and 8 are similar views, but of a lower concrete frame.
Figure 7:
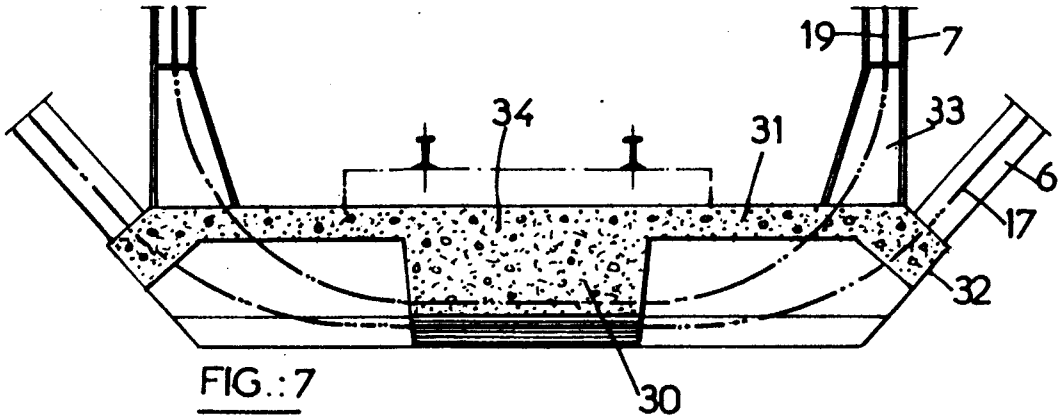

FIGS. 7 and 8 are cross-sections of a variation, in which the lower frame consists of an assembly of prefabricated concrete elements 30 arranged longitudinally one after the other, as shown in FIG. 3.

The elements 30 comprise a flat slab 31 which has on its lateral edges a thickened rib 32 which serves in particular as a support for the diagonal connecting girders 6 and auxiliary connecting girders 7, the latter resting on the element 30 by means of a cage 33 identical to the cage 21 described with reference to FIGS. 7 and 8.

The successive elements 30 are joined together at the point where the connecting girders 6 and 7 are attached. At their end, the elements 30 have an internal reinforcement 34, the elements 34 bearing against each other at their bottom end and leaving between their top parts an empty space 35 which is more or less V-shaped and which is subsequently filled with concrete.

The tubes 36, 37 which contain and guide the prestressing cables 17 and 19 pass through the ends of the slabs 31 and through the reinforcements 34 so as to transmit the prestressing forces to the blocks 30.

Figure 9:
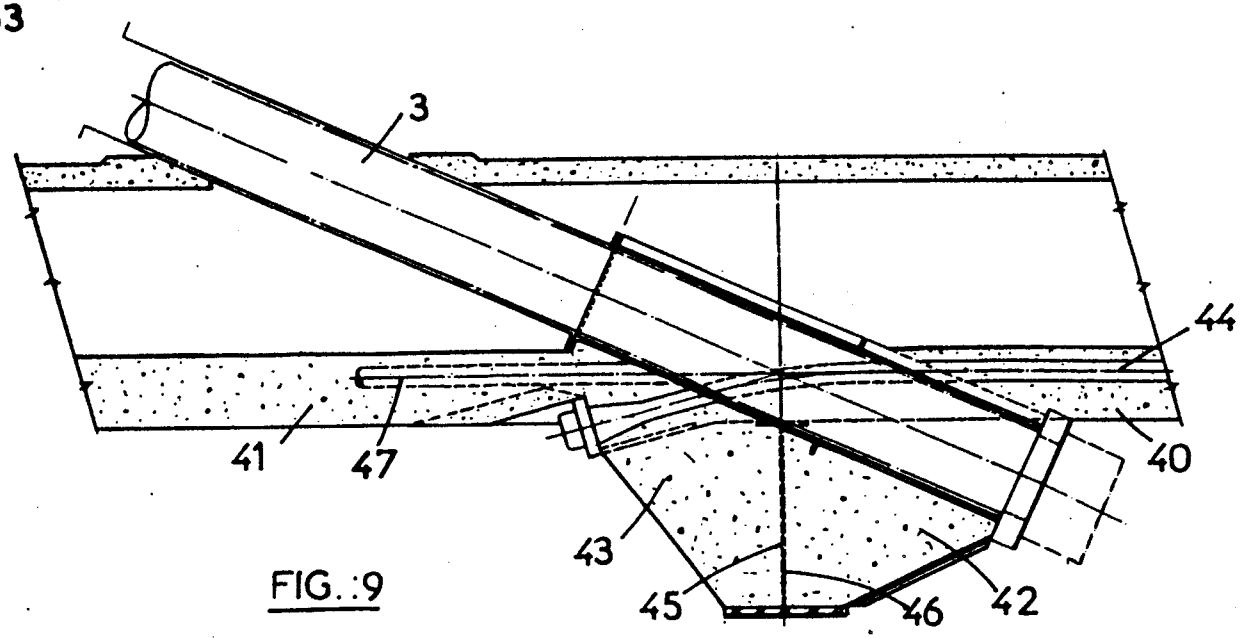
FIG. 9 shows, in enlarged partial longitudinal section, the device for anchoring the stay cables in the upper frame.
Figure 6:
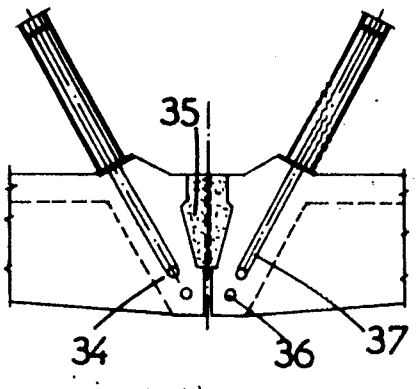
FIGS. 5 and 6 are transverse and longitudinal sections through a lower metal frame.

FIG. 9 shows a detail of the upper frame which, like the lower frame of FIGS. 3, 5 and 6, is formed by an assembly of concrete elements which are prefabricated or cast in position, bearing one against the other in the longitudinal direction.

The ends of two elements 40, 41 are shown. The element 40 has a small block 42, which serves as an anchorage for a stay cable 3 which passes through the slab. A second anchoring block 43 is located opposite thereto on the element 41. It serves for the anchorage of a prestressing cable 44 arranged longitudinally. The two blocks 42, 43 have transverse vertical surfaces 45, 46 by means of which they bear against each other. The tension of the stay cable 3 and the prestressing cable 44 therefore tends to hold them firmly against each other.

47 denotes another longitudinal prestressing cable which passes through the joint between the elements 40 and 41 and is anchored onto elements located further away in the longitudinal direction of the bridge, so as to ensure the rigidity of the entire upper frame.

In other embodiments where the upper frame of the deck is a single piece, at least in the vicinity of the anchorage of a stay cable, the frame has stops, the shape of which may correspond to that of the two assembled blocks 42 and 43, these stops each retaining the anchoring head of a stay cable and at the same time retaining the anchoring head of a longitudinal prestressing cable which exerts a horizontal force in the opposite direction to the horizontal force exerted by the stay cable.

Figure 10:
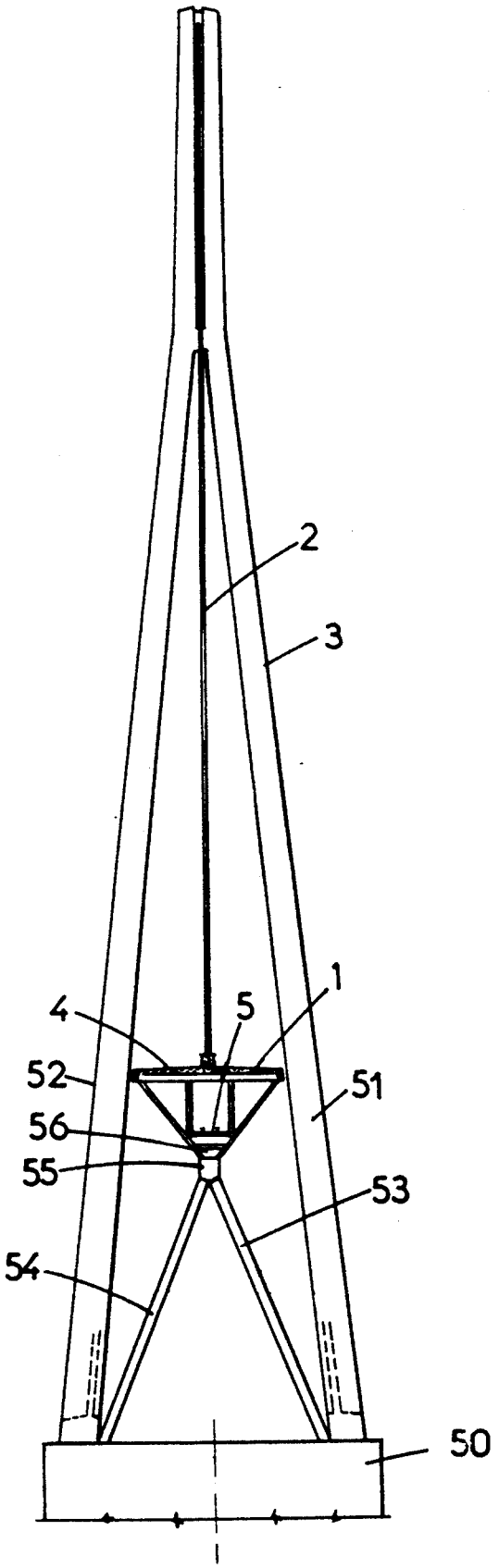
FIG. 10 is a transverse elevation view of an embodiment of a pylon for a bridge according to the invention.

FIG. 10 is a section through the structure in the region of a pylon 3.

Figure 4:
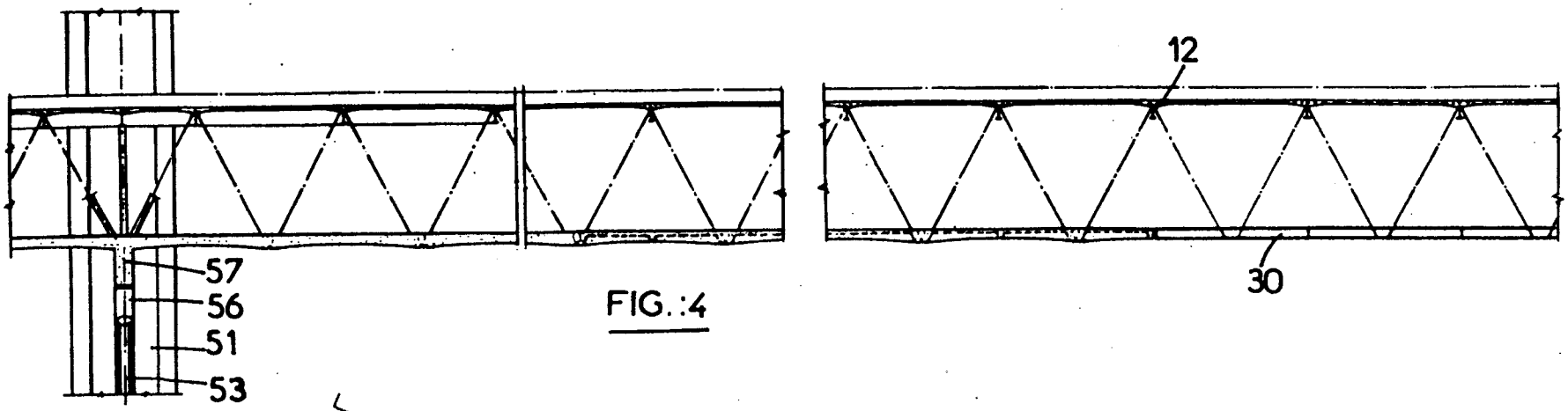
FIG. 4 is a partial longitudinal section through the deck.

This pylon is a metal or concrete structure in the form of an inverted V, the uprights of which rest on a common pier 50. The deck 1 is located between the two uprights 51, 52 of the pylon. The stability of the deck with regard to the transverse horizontal forces is ensured by two slanting girders 53, 54 which rest on the pier 50 at the base of the uprights 51 and 52 and are joined together on a support piece 55 which is secured to the lower deck via a support block 57 visible in cross-section in FIG. 4. Asymmetrical and variable tensions on the uprights 51, 52 of the pylon are thus avoided.

Figure 11:
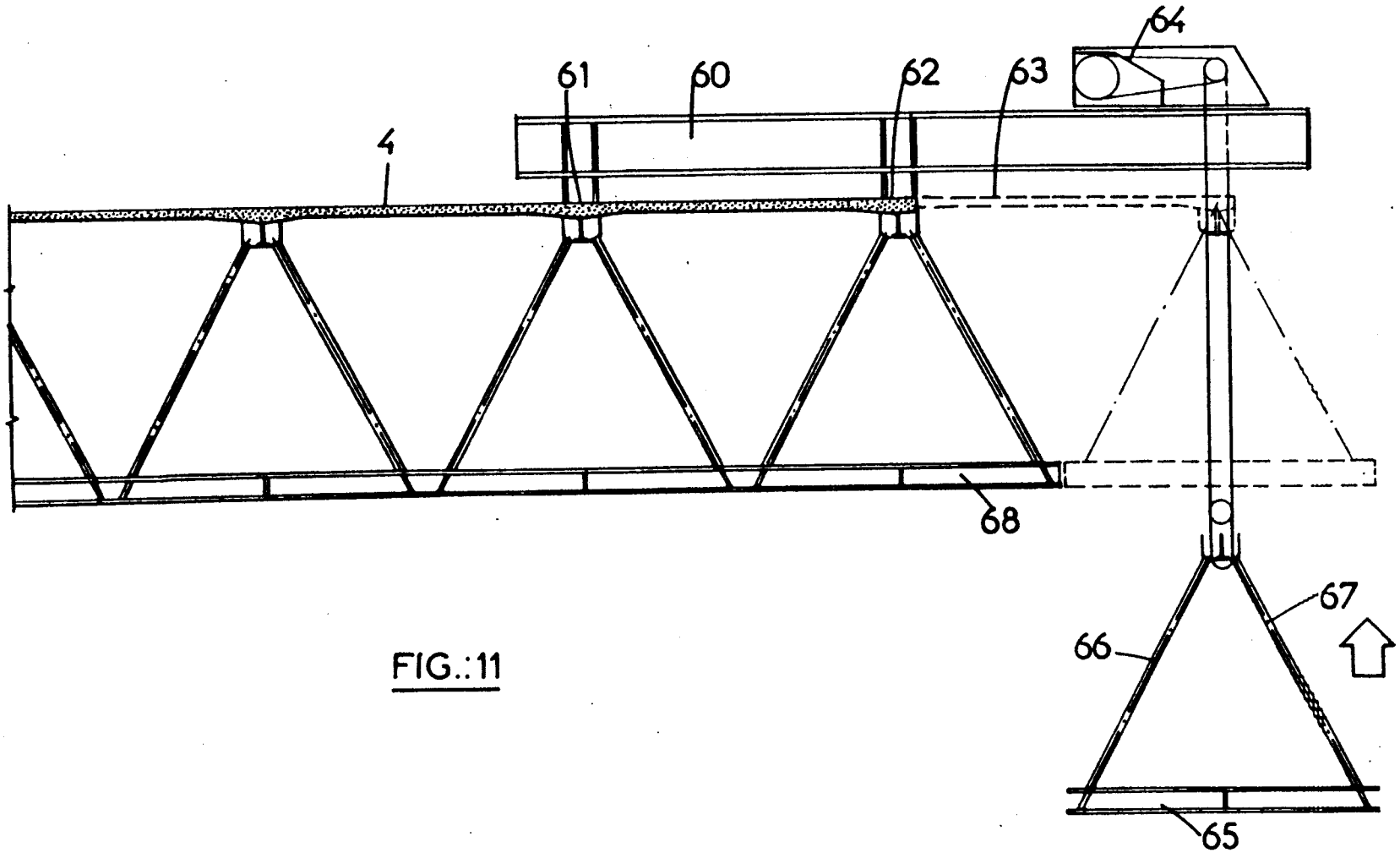
FIG. 11 is a drawing showing an advantageous method of constructing a bridge according to the invention.

FIG. 11 shows a particularly advantageous method of construction for the bridge according to the invention.

A movable girder 60 is mounted on the upper frame 4 and fixed at two successive attachment points 61, 62 for diagonal connecting girders, forming intersections of the spatial lattice. The girder moves forward in cantilever fashion beyond the already constructed part of the bridge, a length 63 of the upper frame corresponding to the distance between two successive connecting girders in the longitudinal direction is first arranged in position, then, with the aid of a winch 64, the assembly consisting of a corresponding length 65 of the lower frame, and the corresponding diagonal and auxiliary girders 66, 67 are simultaneously arranged in position. All that is required then is to secure this triangular element, on the one hand, to the lower deck part 68 already constructed and, on the other hand, to the upper deck part 63 already arranged in position and pretension the assembly. After this, the girder 60 may be displaced by another length, and the operations are recommenced.

I claim:

1. A bridge consisting of a deck and means for supporting this deck, the deck comprising:

an upper frame forming a traveling surface;

a lower frame forming a traveling surface, narrower than the upper frame;

prestressed connecting girders, known as "diagonal members", slanting both relative to the vertical and relative to the length of the bridge and joining the edges of the upper and lower frames;

auxiliary connecting girders, also prestressed, situated in vertical planes passing through the edges of the lower frame, wherein at least one prestressing cable of a diagonal girder is anchored to the edge of the upper frame, and passes tranversely through the lower frame and then through the diagonal girder which is symmetrical therewith relative to the longitudinal vertical plane of symmetry of the bridge, and is anchored onto the opposite edge of the upper frame.

2. The bridge as claimed in claim 1, wherein at least one prestressing cable of an auxiliary girder is anchored on the upper frame, passes transversely through the lower frame and then through the auxiliary girder which is symmetrical therewith relative to the longitudinal vertical plane of symmetry of the bridge.

3. The bridge as claimed in claim 1, wherein the auxiliary girders are located at the intersection of the vertical planes passing through the edges of the lower frame and the slanting planes perpendicular to said vertical planes, containing the diagonal girders (6).

4. The bridge as claimed in claim 1, wherein the upper frame consists of a thin slab reinforced by transverse girders situated at the point where the diagonal girders and, where applicable, the auxiliary girders join said upper frame.

5. The bridge as claimed in claim 1, wherein the lower frame is of the metal type with longitudinal cages, having concrete blocks for effecting connection with the prestressing cables of the diagonal and auxiliary girders.

6. The bridge as claimed in claim 1, wherein the lower frame consists of prefabricated concrete elements assembled in the longitudinal direction.

7. The bridge as claimed in claim 1 and of the radiating cable-stayed type, wherein the upper deck is formed by the assembly of elements prefabricated or cast in position, at least some of which have a stop intended to retain the anchoring head of a stay cable, and the adjacent element has an auxiliary stop intended to bear against the stop retaining the anchoring head of the stay cable, this auxiliary stop being intended to retain the anchoring head of a longitudinal prestressing cable of the deck, exerting a force directed longitudinally in the opposite direction to the stay cable, to such an extent that the combined action of the stay cable and the prestressing cable tends to clamp the two prefabricated elements against each other.

8. The bridge as claimed in claim 1 and of the radiating cable-stayed type, wherein the upper frame has stops each retaining the anchoring head of a stay cable and simultaneously retaining the anchoring head of a longitudinal prestressing cable exerting a horizontal force in the opposite direction to the horizontal force exerted by the stay cable.

9. The bridge as claimed in claim 1 and of the radiating cable-stayed type, with at least one pylon in the shape of an inverted V for supporting the stay cables, wherein the deck is located between the uprights of the pylon, and wherein slanting braces, situated in the transverse plane of the pylon, join the deck to the pier supporting the pylon, so as to ensure the stability of the deck with regard to horizontal forces.

10. Method of constructing a bridge as claimed in claimed 1 comprising the steps of:

(a) constructing a first section of the deck, said section having an end;

(b) mounting a movable girder on said upper frame of said first section and fixing said movable girder at two successive attachment points of said diagonal girders, said movable girder moving forward in a cantilever fashion beyond said end of said first section;

(c) assembling to said first section of the deck a length of upper frame;

(d) preparing near said end of the first section an assembly consisting of a length of lower frame corresponding to said length of upper frame and corresponding diagonal and auxiliary girders;

(e) assembling said assembly to said first section of the deck and to said length of upper frame with the end of said movable girder; and (f) repeating steps (b) to (e) until the bridge is constructed.

* * * * *